US005125525A

United States Patent [19]

Tucker

[11] Patent Number: 5,125,525

[45] **Date of Patent: * Jun. 30, 1992**

[54] PROTECTIVE CAP FOR BEVERAGE CONTAINERS

[76] Inventor: Terence Tucker, 33811 Shannon La., San Juan Capistrano, Calif. 92675

[ * ] Notice: The portion of the term of this patent subsequent to Oct. 8, 2008 has been disclaimed.

[21] Appl. No.: 689,703

[22] Filed: Apr. 15, 1991

Related U.S. Application Data

[63] Continuation of Ser. No. 598,175, Oct. 15, 1990, Pat. No. 5,054,640.

[51] Int. Cl.[5] ..... B65D 51/18

[52] U.S. Cl. ..... 220/254; 220/306; 220/713; 220/717; 206/151

[58] Field of Search ..... 220/90.2, 90.4, 254, 220/306, 338, 703, 711, 713, 716, 717; 215/237

[56] References Cited

U.S. PATENT DOCUMENTS

| | | | |
|---|---|---|---|
| 110,148 | 12/1870 | Leach . | |
| D146,355 | 2/1947 | Guarnaschelli | D58/26 |
| D200,820 | 4/1965 | Blakslee | D58/26 |
| D258,496 | 3/1981 | Ludwig et al. | D9/439 |
| 4,721,22 | 1/1988 | Haythornwaite | 220/234 |
| 1,463,892 | 8/1923 | Ingram et al. . | |
| 2,754,866 | 7/1956 | Coltman, Jr. . | |
| 2,764,199 | 9/1956 | Tupper . | |
| 3,085,710 | 4/1963 | McIlroy | 220/90.4 |
| 3,187,919 | 6/1965 | Inglis . | |
| 3,202.448 | 8/1965 | Stern et al. | 294/87.2 |
| 3,224,575 | 12/1965 | Whiteford | 206/65 |
| 3,250,564 | 5/1966 | Stern et al. | 294/87.2 |
| 3,281,180 | 10/1966 | Spery | 294/87.2 |
| 3,310,334 | 3/1967 | Murphy | 294/87.28 |
| 3,350,131 | 10/1967 | Tanzer | 294/87.2 |
| 3,362,572 | 1/1968 | Pelley . | |
| 3,372,832 | 3/1968 | Yeater et al. . | |
| 3,421,654 | 1/1969 | Hexel . | |
| 3,510,021 | 5/1970 | Silver | 215/9 |
| 3,583,591 | 6/1971 | Hayashida | 315/40 |
| 3,589,509 | 6/1971 | Mascia et al. | 206/65 |
| 3,601,439 | 8/1971 | Poupitch | 294/87.2 |
| 3,737,066 | 6/1973 | Ames . | |
| 3,744,655 | 7/1973 | Nixdorff, Jr. | 215/9 |
| 4,098,439 | 7/1978 | Blow, Jr. et al. | 222/531 |
| 4,412,629 | 11/1983 | Dart et al. | 220/90.4 |
| 4,537,326 | 8/1985 | Morehead | 220/269 |
| 4,564,116 | 1/1986 | Prohaska | 215/256 |
| 4,790,444 | 12/1988 | Terzi | 220/90.2 |
| 4,796,774 | 1/1989 | Nabinger | 220/90.4 |
| 4,869,389 | 9/1989 | Cerrone, Jr. | 220/90.2 |
| 4,938,379 | 7/1990 | Kellner | 220/370 |
| 4,961,510 | 10/1990 | Dvoracek | 220/90.4 |

*Primary Examiner*—Stephen Marcus
*Assistant Examiner*—Nova Stucker
*Attorney, Agent, or Firm*—Stetina and Brunda

[57] ABSTRACT

A protective cap for canned soft drinks and the like is disclosed. The cap comprises an outer periphery configured to receive and snap over the upper surface of a conventional soft drink beverage can. A lip guard extends axially downward from the cap to provide a sanitary drinking surface. A grate is positioned to cover the opening in the top of the can through which the beverage may be consumed. The grate is formed as an integral portion of the molded cap. A hinged cover can rotate between opened and closed positions to permit consumption of the soft drink when in the opened position and to seal the container to prevent contamination from airborne debris and small insects when in the closed position. A detent formed upon the lower surface of the cover is received between adjacent bars of the grate to latch the cover in the closed position.

11 Claims, 2 Drawing Sheets

PROTECTIVE CAP FOR BEVERAGE CONTAINERS

This application is a continuation of application Ser. No. 07/598,175, filed Oct. 15, 1990, now U.S. Pat. No. 5,054,640.

FIELD OF THE INVENTION

The present invention relates generally to caps for beverage containers, and more particularly to a protective cap for canned soft drinks and the like.

BACKGROUND OF THE INVENTION

Protective caps which prevent insects and other contamination from entering beverage containers while permitting consumption of the beverage contained therein are well known. A grating or similar set of apertures typically permits consumption of the beverage while preventing bees and other insects, lured by the sugar content of the beverage, from entering the container. Such prior art protective caps generally snap over the upper end of a soft drink container such that an opening defined by the grate is positioned directly over the opening in the container. Thus, the user can consume the beverage by drinking the liquid directly from the container through the protective cover.

The problem of insects, particularly bees, entering sugar-sweetened soft drinks and the like is common, particularly when such soft drinks are consumed outdoors. Besides being unappetizing and generally ruining the soft drink, such occurrences can be dangerous in that they may result in a bee sting or other insect bite or sting. In fact, there are cases where a bee sting inside the mouth or throat of a user has caused death.

While such prior art protective covers do serve adequately to prevent bees and other large insects from entering the beverage container, they are inadequate in preventing smaller insects, e.g. ants, mosquitos, and gnats, from entering the can. Such prior art protective covers are also incapable of preventing airborne contamination such as wind-blown dust, dirt, and the like from entering the beverage container. Thus, while such prior art devices have proven generally acceptable for their intended purposes, they possess inherent deficiencies which detract from their overall effectiveness in the marketplace.

SUMMARY OF THE INVENTION

The present invention specifically addresses and alleviates the above-mentioned deficiencies associated in the prior art. More particularly, a protective cap for canned soft drinks and the like is disclosed. The cap comprises an outer periphery configured to receive and snap over the upper surface of a soft drink can to be frictionally retained thereon. A lip guard extends axially downward from the cap for approximately five-eighths of an inch to provide a sanitary drinking surface. A grate is positioned to cover the opening in the top of the can through which the beverage may be consumed. The grate is formed as an integral portion of the molded cap. A hinged cover is pivotable between opened and closed positions to permit consumption of the soft drink when in the opened position and to seal the container to prevent contamination from airborne debris and small insects when in the closed position. A detent or latch formed upon the lower surface of the cover is received between adjacent bars of the grate to latch the cover in the closed position.

The grate is configured to permit substantially unrestricted flow of the beverage from the container while preventing most common larger insects from being able to enter the container. This eliminates the possibility of bee stings to the user's mouth and throat resulting from the consumption of a bee.

The hinged cover likewise prevents smaller insects as well as wind-blown debris from entering the container. Thus, the user may place the cover in a closed position and leave the soft drink unattended without the fear that ants or the like may crawl therein or that wind-blown dirt or the like may contaminate the beverage The hinged cover is particularly beneficial when consuming canned beverages at the beach where sand is likely to be blown or kicked upon the beverage container. Such occurrences are quite common when a beverage container is placed upon the sandy surface of the beach.

Thus, the protective cap of the present invention protects the user from ingestion of such debris and also prevents the waste of the contained beverage. Additionally, severe injuries and possibly death may be prevented by keeping these and other dangerous contaminants out of the beverage container. Further, the lip guard provides a sanitary surface from which the user may drink the beverage.

DETAILED DESCRIPTION OF THE PREFERRED EMBODIMENT

Figure 1:
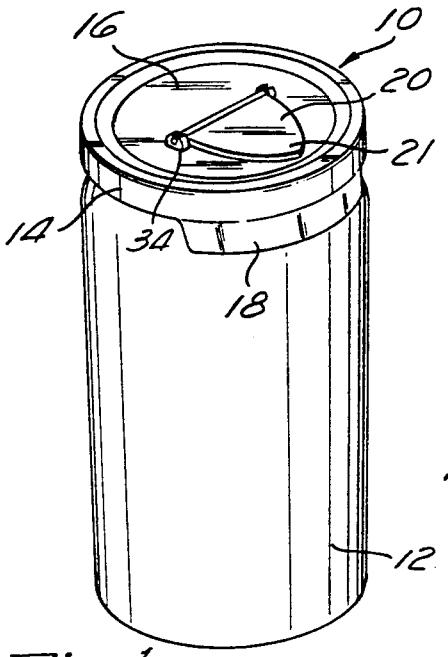
FIG. 1 is a perspective view of a beverage container having a protective cap of the present invention installed thereon.

The detailed description set forth below in connection with the appended drawings is intended as a description of the presently preferred embodiment of the invention, and is not intended to represent the only form in which the present invention may be constructed or utilized. The description sets forth the functions and sequences of steps for constructing and operating the invention in connection with the illustrated embodiments. It is to be understood, however, that the same or equivalent functions and sequences may be accomplished by different embodiments that are also intended to be encompassed within the spirit and scope of the invention.

The protective cap of the present invention is illustrated in FIGS. 1–7 which depict a presently preferred embodiment of the invention. Referring now to FIGS. 1–4, the protective cap 10 is removably attached to a conventional soft drink, beer, or the like container 12

(such as an aluminum beverage can) and is generally comprised of a outer periphery 14, top planar surface 16, hinged cover 20, and grate 24. The protective cap 10 is sized and configured to receive and snap over the upper lip 42 (shown in FIGS. 4 and 5) of a soft drink container 12 and thereby be frictionally retained thereon.

A lip guard 18 extends axially downward from the outer periphery 14 to provide a sanitary drinking surface such that the user's mouth need not come into direct contact with the beverage container 12. A grate 24 is disposed within an opening 46 through which the beverage may be ingested.

A detent post 28 formed upon the hinged cover 20 is received between adjacent bars 25 of the grate 24 which form aperture 26. The diameter of the detent pin 28 is sized slightly larger than the distance between adjacent bars 25 whereby the detent pin 28 therefore functions in combination with aperture 26 to form a latch which frictionally secures cover 20 in the closed position.

The bars 25 of the grate 24 are approximately one-sixteenth of an inch in width and spaced approximately one-sixteenth of an inch apart. Diagonal cross members 23 provide structural support to the bars 25 to prevent their inadvertent distortion during use and to maintain the rigidity required such that aperture 26 will function in combination with detent pin 28 to latch the hinged cover 20 in the closed position.

Pivot pins 22 formed upon either side of the proximal end of cover 20 are received by sockets 34 formed upon the upper surface 16 of the protective cap 10 such that the cover 20 may be hingeably rotated between opened and closed positions.

In the preferred embodiment of the present invention, openings 35 formed in the upper-most portion of the sockets 34 permit the pivot pins 22 to be snapped therein during assembly.

Figure 2:
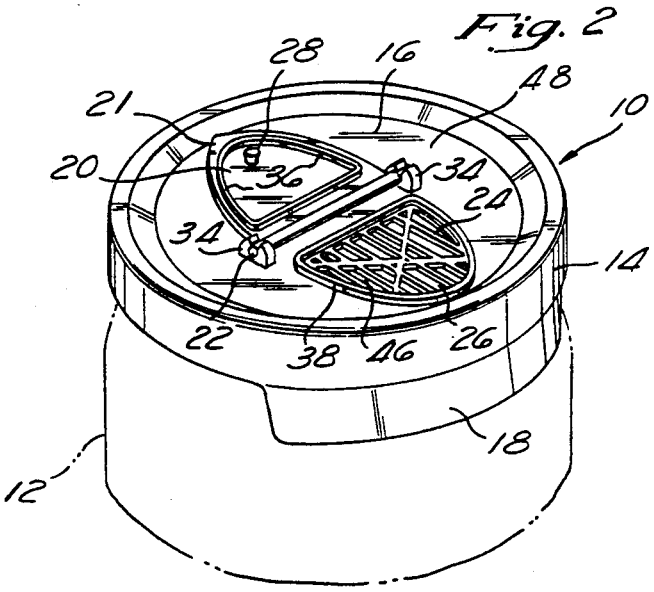
FIG. 2 is an enlarged perspective view of the protective cap of FIG. 1.
Figure 3:
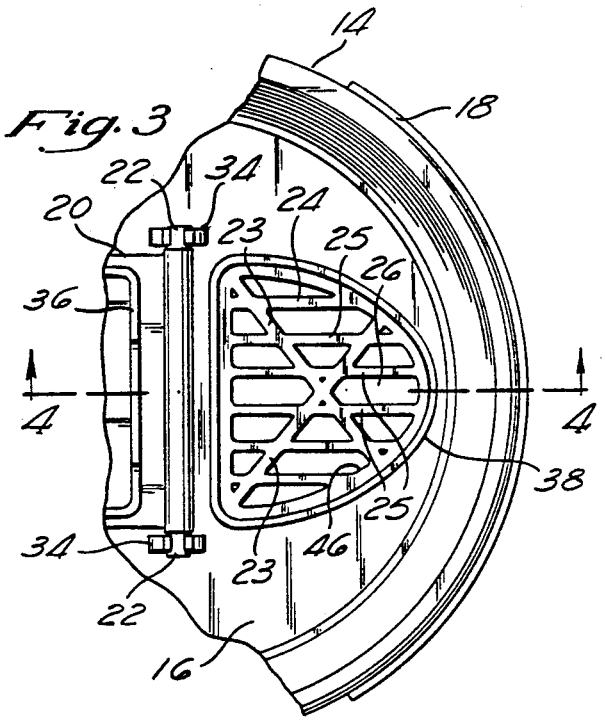
FIG. 3 is an enlarged sectional top plan view of the grate of the protective cap of FIG. 2.
Figure 4:
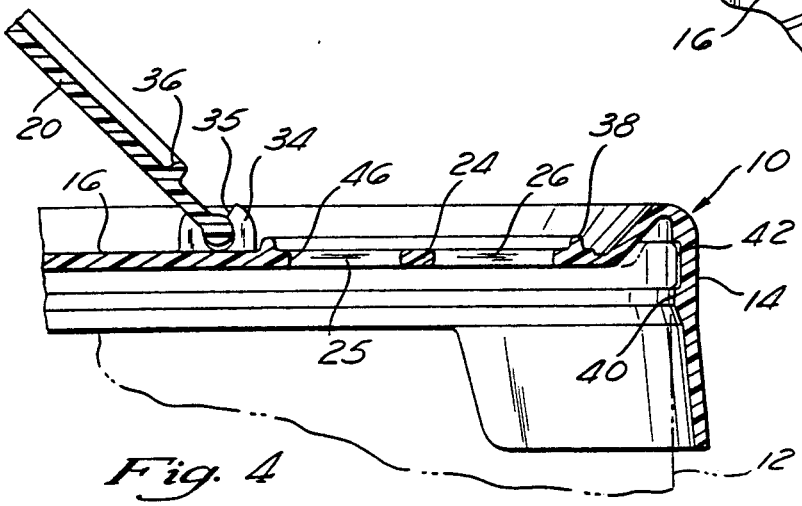
FIG. 4 is a cross-sectional side view of the protective cap of the present invention.

Thus, the hinged cover 20 may be rotated to an opened position, as illustrated in FIGS. 2–4, such that the user may pour or drink the beverage from the container 12. To prevent small insects and airborne debris from entering the container 12, the hinged cover 20 may be disposed in a closed position as illustrated in FIG. 1. This is accomplished by simply manually rotating the hinged cover 20 down over the grate 24 and snapping it into place. Snapping the hinged cover 20 into the closed position causes the detent pin 28 to be frictionally received by the aperture 26 formed in the grate 24 and to be removably captured therein. The two bars 25 on either side of the aperture 26 frictionally engage and hold the detent pin 28 such that the hinged cover 20 remains in the closed position until manually opened by the user. The distal end of the detent pin 28 may be flaired slightly to facilitate engagement with the bars 25.

To open the hinged cover 20, the user simply inserts the tip of a finger, or a fingernail, beneath the distal end 21 of the hinged cover 20 and then pries the hinged cover upward to disengage the detent pin 22 from the two bars 25 of the grate 24.

With particular reference to FIG. 4, the protective cover 10 of the present invention is removably attached to a beverage container 12 by placing the protective cap 10 atop the beverage container 12, as shown in FIGS. 1–3 and pressing firmly axially downward. This action causes the annular cap detent 40 formed upon the inner surface of the outer periphery 14 of the cap 10 to engage the lip 42 of the beverage container 12. Thus, the protective cap 10 of the present invention snaps firmly into place where it will remain until manually detached.

A lip 36 formed upon the cover 20 cooperates with a lip 38 formed upon the planar surface 16 around the aperture 46 (best shown in FIG. 2) to seal the container 12 such that small insects and wind-blown debris cannot enter the container 12 when the cover 20 is in the closed position.

Figure 5:
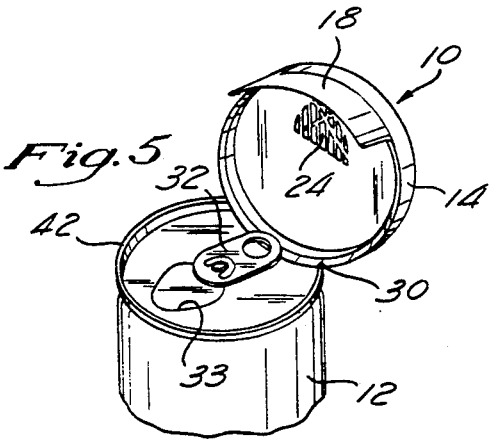
FIG. 5 illustrates the use of the protective cap of the present invention in the opening a pop-top beverage container.

Referring now to FIG. 5, the peripheral lip 30 of the protective cap 10 of the present invention is specifically formed to be used to pry the key 32 of the beverage container 12 upward in order to open the beverage container 12. This is particularly advantageous due to the difficulties occasionally encountered, particularly by women with long and/or artificial fingernails, in opening such containers. Small children also experience difficulty in opening such containers. Thus, the protective cap of the present invention provides a simple and convenient means of opening pop-top containers in addition to preventing the contamination of the contents of such containers.

Figure 6:
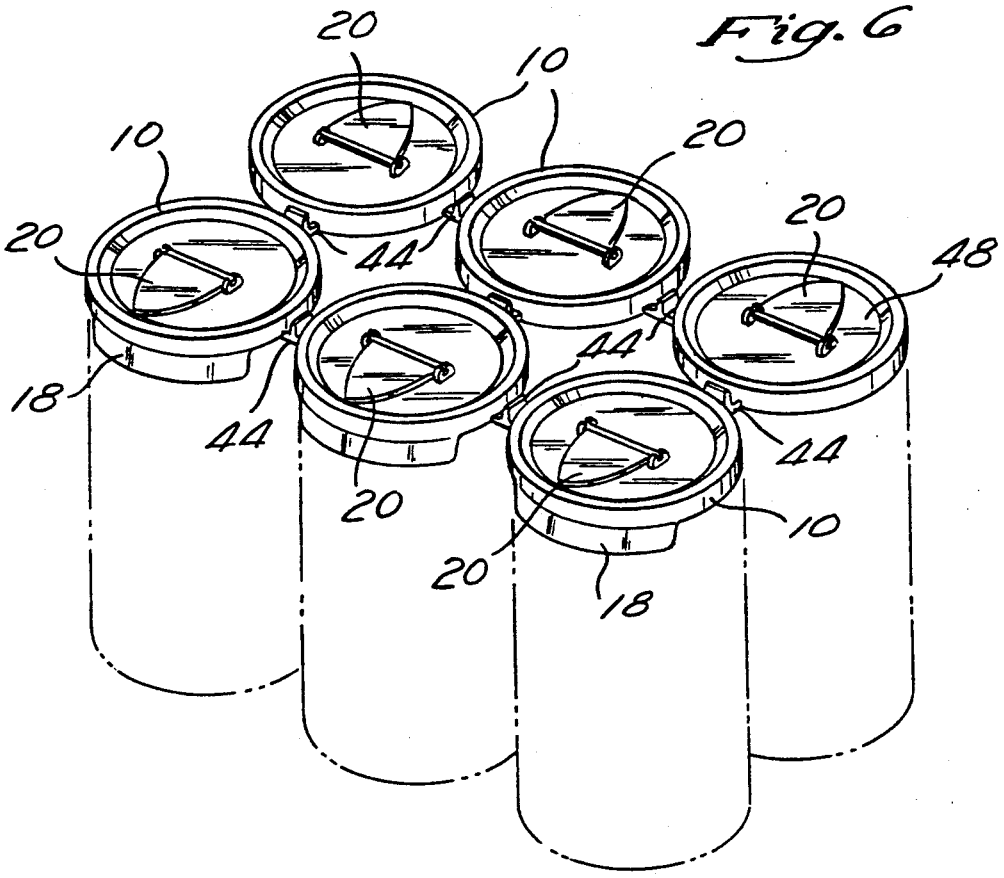
FIG. 6 is a perspective view of a six-pack beverage package formed using a plurality of protective caps of the present invention.
Figure 7:
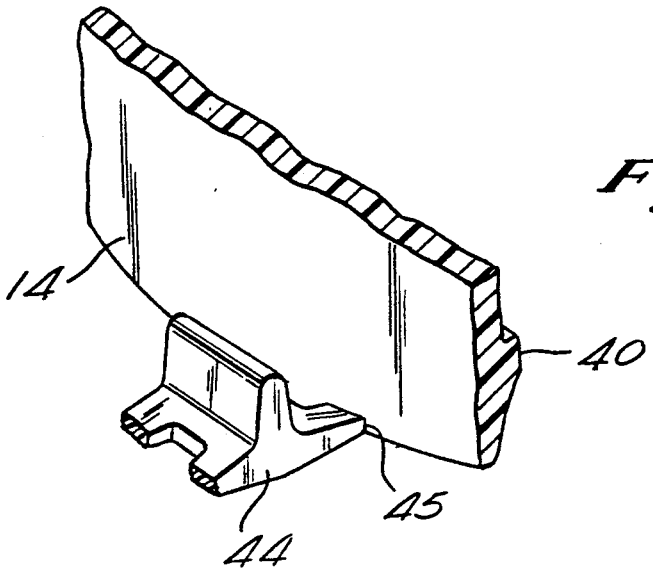
FIG. 7 is an enlarged sectional view of the connecting links of FIG. 6.

Referring now to FIGS. 6 and 7, a plurality of protective caps 10 of the present invention may be formed in an array such that they serve to form a package or six-pack carrier. Thus, beverages may be sold with protective caps 10 attached such that they both form a package carrier and provide a premium to the customer. Connecting links 44 attach each protective cap 10 to at least two adjacent protective caps 10 such that a plurality of such attached beverage containers may be carried and handled as a unit. The connecting links 44 are formed to have a weak area at the innerface 45 to the outer periphery 14 of the cap 10 such that they will detach therefrom when a deliberate attempt is made to forcibly remove one beverage container 12 from the remainder, yet remain intack during normal articulation such that a user may carry a conventional six-pack merely by grasping the protective cap array.

The protective caps 10 of FIGS. 6 and 7 may be formed without the hinged cover 20 to facilitate the stacking of containers having the protective caps 10 installed thereon. Forming protective caps 10 without hinged covers 20 permits the bottom of a container 12 to be received by the recess 48 formed in the upper surface of the protective cap 10. Thus, forming the protective cap 10 without the hinged cover permits vertical stacking of a plurality of containers wherein lateral slipping is reduced by the fit of the bottom of each upper container into the protective cap of each lower container.

The protective cap 10 of the present invention is preferably formed by the injection molding of plastic. The cap 10 and cover 20 are formed as separate pieces which are then assembled to provide the protective cap 10 of the present invention. Assembly requires only the snapping of the pivot pins 22 into their respective sockets 34.

It is understood that the exemplary protective cap described herein and shown in the drawings represents only a presently preferred embodiment of the invention. Indeed, various modifications and additions may be made to such embodiment without departing from the spirit and scope of the invention. For example, the size and shape of the opening 46 and hinged cover 20 need not conform substantially to the size and shape of the opening 33 which is formed in the beverage container 12. Rather, those skilled in the art will recognize that various sizes and shapes are likewise suitable. Also, the precise configuration of the lip guard 18 is not crucial to the practice of the present invention. Anyconfiguration that permits the user to drink from the beverage container without permitting his mouth to directly contact the container 12 is suitable. Thus, these and other modifications and additions may be obvious to those skilled in the art and may be implemented to adapt the present invention for use in a variety of different applications.

What is claimed is:

1. A protective cap positionable on top of a beverage can having a generally horizontal top and a generally vertical side wall, said protective cap comprising:

a cap member having a generally concave underside being configured to receive the top of said beverage can therein;

an aperture formed in said cap member to permit liquid to be poured out of the top of said beverage can through said aperture;

a lip guard member attached to and extending downwardly from said cap member such that the lower lip of a human being may be positioned against said lip guard while said human being drinks liquid from said beverage can through said aperture;

a lid member;

said lid member being sized and configured to fully cover said aperture;

said lid member being movably mounted on said cap member so as to be alternatively movable between:

(a) a "closed" position wherein said lid member covers said aperture; and (b) an "open" position wherein said lid member is disposed sufficiently away from said aperture to allow said human being to drink from said aperture without interference from said lid; and a detent means formed upon said lid member and said cap member for releasably locking said lid member in said closed position;

a protective grate positioned over said aperture, said grate being configured to deter passage of insects and solid objects into the beverage can, while allowing liquid to be poured out of the beverage can through said aperture.

2. The protective cap of claim 1 wherein said cap member has a round outer periphery and wherein said lip guard member comprises an arcuate strip attached to a portion of the outer periphery of said cap member and extending downwardly therefrom.

3. The protective cap of claim 1 wherein said lip guard is formed as a unitary part of, and is coextensive with, said cap member.

4. The protective cap of claim 1 wherein said lip guard extends approximately ⅝ of an inch below said can top.

5. A protective cap for a beverage can comprising (a) a round, generally horizontal top having an outer circumference of a first diameter, (b) a generally cylindrical can sidewall attached to and extending downwardly from the outer circumference of said round can top, and (c) wherein said generally cylindrical sidewall is of said first diameter at its point of connection to said can top and, therebelow, enlarges diametrically from said first diameter to a second diameter which is larger than said first diameter, said protective cap comprising:

a cap member having an upper surface and a concave underside, the concave underside of said cap member being sized and configured to receive the round top of said can therein;

an aperture formed in said cap member to permit liquid to be poured out of the top of said beverage can through said aperture;

a lip guard member attached to at least a portion of the outer edge of said cap member such that the lower lip of a human being may be pressed against said lip guard member while the human being drinks liquid from said beverage can through said aperture;

said lip guard member being configured to accommodate and pass over at least part of the portion of said can sidewall which enlarges diametrically from said first diameter to said second diameter; and a lid member sized and configured to cover said aperture;

said lid member being movably mounted on said cap member so as to be alternately movable between:

(a) a "closed" position wherein said lid covers said aperture; and (b) an "open" position wherein said lid is disposed sufficiently away from said aperture to allow said human being to drink from said aperture without interference from said lid;

said lid configured such that, when in said closed position, said lid will frictionally engage an adjacent portion of said cap member to frictionally retain said lid member in said "closed" position.

6. The protective cap of claim 5 wherein said lip guard member is of generally arcuate configuration and extends downwardly over from a portion of the outer edge of said cap member.

7. The protective cap of claim 6 wherein said arcuate lip guard is formed as a unitary part of, and is coextensive with, said cap member.

8. The protective cap of claim 5 further comprising:

a grate formed over said aperture, said grate being sized and configured to deter passage of insects and solid objects into said beverage can through said aperture while permitting outflow of liquid from said beverage can through said aperture.

9. The protective cap of claim 5 wherein said lip guard has an inner surface which resides in juxtaposition to said can sidewall and wherein said inner surface is outwardly angled to accommodate and pass over the portion of said sidewall which enlarges diametrically from said first diameter to said second diameter.

10. The protective cap of claim 5, wherein said lip guard extends approximately ⅝ of an inch below said can top.

11. A protective cap positionable on top of a beverage can having a generally horizontal top and a generally vertical side wall, said protective cap comprising:

a cap member having an underside being configured to receive the top of said beverage can therein;

an aperture formed in said cap member to permit liquid to be poured out of the top of said beverage can through said aperture;

a lip guard member attached to and extending downwardly from said cap member such that the lower lip of a human being may be positioned against said lip guard while said human being drinks liquid from said beverage can through said aperture;

a lid member;

said lid member being sized and configured to cover said aperture;

said lid member being movably mounted on said cap member so as to be alternatively movable between a closed position wherein said lid member covers said aperture and an open position wherein said lid member is disposed sufficiently away from said aperture to allow said human being to drink from the aperture without interference from said lid;

detent means formed upon said cap member and said lid member for releasably locking said lid member is said closed position; and protective means positioned over said aperture, said protective means being configured to deter passage of insects and solid objects into the beverage can through said aperture.

* * * * *